US005221191A

United States Patent [19]

Leyderman et al.

[11] Patent Number: 5,221,191

[45] Date of Patent: Jun. 22, 1993

[54] HORIZONTAL ROTARY COMPRESSOR

[75] Inventors: Alexander D. Leyderman, Manlius; Martin M. Mertell, East Syracuse; Donald Yannascoli, Manlius, all of N.Y.

[73] Assignee: Carrier Corporation, Syracuse, N.Y.

[21] Appl. No.: 874,884

[22] Filed: Apr. 29, 1992

[51] Int. Cl.[5] ..... F04C 18/00; F04C 29/02

[52] U.S. Cl. ..... 417/312; 417/372; 417/369; 417/902; 418/94

[58] Field of Search ..... 417/312, 366, 367, 368, 417/369, 372, 902; 418/181, 94

[56] References Cited

U.S. PATENT DOCUMENTS

| | | | |
|---|---|---|---|
| 4,355,963 | 10/1982 | Tanaka et al. | 418/63 |
| 4,391,573 | 7/1983 | Tanaka et al. | 418/63 |
| 4,457,671 | 7/1984 | Watanabe | 417/312 |
| 4,472,121 | 9/1984 | Tanaka et al. | 418/63 |
| 4,569,648 | 2/1986 | Asami et al. | 418/63 |
| 4,624,630 | 11/1986 | Hirahara et al. | 418/63 |
| 4,645,429 | 2/1987 | Asami et al. | 417/312 |
| 4,729,728 | 3/1988 | Gromoll et al. | 418/88 |
| 4,759,698 | 7/1988 | Nissen | 418/94 X |
| 4,781,572 | 1/1988 | Ozu et al. | 417/369 |
| 4,968,223 | 11/1990 | Da Costa | 417/366 |
| 4,973,230 | 11/1990 | Da Costa | 417/312 |
| 4,979,879 | 12/1990 | Da Costa | 417/312 |
| 5,067,878 | 11/1991 | Da Costa | 417/312 |

*Primary Examiner*—Richard E. Gluck

[57] ABSTRACT

In a horizontal rotary compressor the gas path from the muffler is between the rotor and stator whereupon the flow direction is changed 180° and the flow takes place between the stator and the upper shell. Oil drainage to the sump is in a flow path between the stator and the lower shell. The gas and oil paths serve to cool the rotor and the stator windings. Also, the gas flow reduces oil circulation from the compressor.

4 Claims, 2 Drawing Sheets

HORIZONTAL ROTARY COMPRESSOR

BACKGROUND OF THE INVENTION

Hermetic compressors are most commonly operated in a vertical orientation so that lubrication for the shaft, bearings, running gear, etc., is, typically, supplied by a passive centrifugal pump incorporated into the drive shaft. Oil is drawn from a sump which is located at the bottom of the compressor shell and enters the pump through an orifice in the bottom of the shaft. The parts requiring lubrication are, normally, no more than a foot or so above the oil level of the sump so that a small increase in the oil pressure due to its radial acceleration in sufficient to supply the oil to the required locations. This relatively simple, passive lubrication system is a primary reason why most hermetic compressors are designed to operate in a vertical position. In this orientation, the compressor height-to-diameter ratio is generally two, or more. By comparison, a typical reciprocating compressor of the same capacity has a height-to-diameter ratio of approximately 1.5.

For many applications, the height of the compressor is a primary factor because of packaging considerations. Very often, the height of an air conditioning, refrigeration or heat pump unit is more important than its width or depth. Accordingly, a distinct advantage could be realized if the compressor could be designed to operate in a horizontal orientation. However, in changing the orientation of a hermetic compressor from a vertical to a horizontal orientation, there are significant changes in the lubrication system and gas flow paths. The motor, cylinder, and running gear will extend below the level of the oil in the sump although it is not necessary that all of the members be exposed to the oil sump. The parts to be lubricated are located no more than a few inches above the sump as opposed to a foot, or more, in a vertical unit, but the drainage paths are shorter and over different parts. The oil sump blocks some normally used gas paths which are used in cooling the motor and removing entrained oil and some of the drainage paths can contribute to oil entrainment.

SUMMARY OF THE INVENTION

A high side rotary compressor is horizontally oriented which reduces the height by a half as compared to a vertical unit. Since the oil sump is no longer located at what is now an end, the length of the shell can be reduced by the amount necessary to define the sump and to accommodate the oil pickup tube carried by the eccentric shaft. Lubricant is drawn into the crankshaft bore by differential pressure which may be aided by a rotor fan on the eccentric shaft. The entire discharge flow passes through the motor, turns 180° and flows between the stator and the upper shell. The oil not delivered for lubrication returns to the main sump by passing between the lower shell and the stator.

It is an object of this invention to reduce oil circulation in a hermetic horizontal rotary compressor.

It is another object of this invention to redirect the compressed refrigerant flow within a hermetic horizontal rotary compressor to reduce oil circulation and improve overall efficiency while maintaining a sufficient lubricant supply within the compressor shell.

It is a further object of this invention to reduce the height and cubage of a hermetic rotary compressor.

These objects, and others as will become apparent hereinafter, are accomplished by the present invention.

Basically, lubricant is drawn into the eccentric shaft bore due to a differential pressure created as a result of the rotation of the eccentric shaft. Some of the lubricant is forced by centrifugal force through passages leading to the shaft bore and thereby serves to lubricate the device. Excess lubricant flows from the motor end of the shaft bore into the sump via a passage between the shell and the stator. The compressed gas serially passes from the compression chamber into the muffler, then through the annular space between the rotor and stator. After passing through the motor, the compressed gas turns 180° and passes between the stator and the upper portion of the shell and then through the discharge to the refrigeration system.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
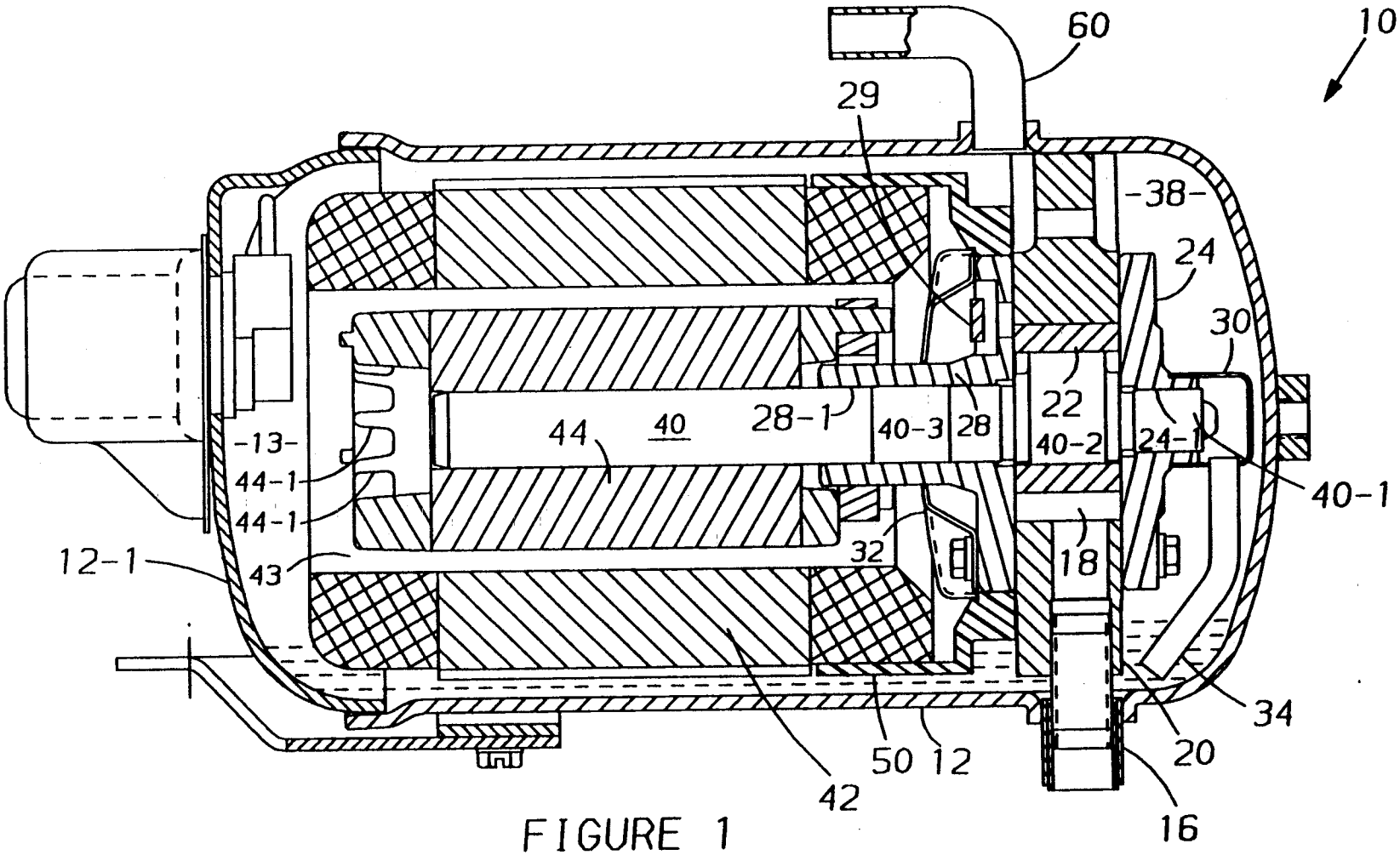
FIG. 1 is a vertical sectional view of a hermetic rotary compressor employing the present invention.
Figure 2:
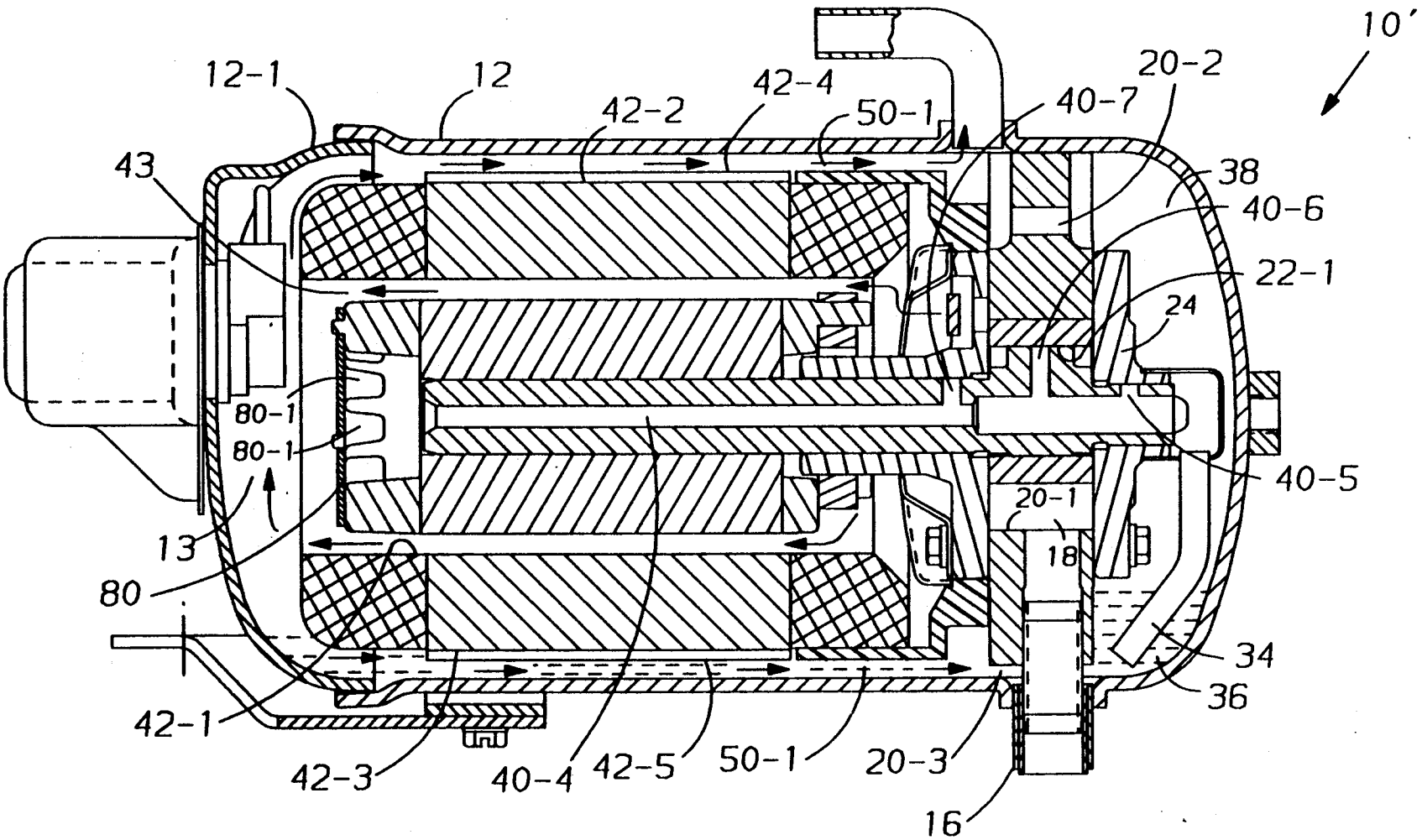
FIG. 2 is a vertical sectional view corresponding to FIG. 1, but showing a modified device.

In FIG. 1, the numeral 10 generally designates a high side hermetic rotary compressor which structurally differs from modified compressor 10' of FIG. 2 only by the addition of rotor fan 80 to compressor 10'. Thus, while FIGS. 1 and 2 could be presented as essentially identical, it is believed that the presenting of some of the members as unsectioned in one of the Figures and less cluttered labeling will aid in understanding. In FIGS. 1 and 2, the numeral 12 generally designates the shell or casing and the numeral 12-1 designates the cover of the casing. Suction tube 16 is sealed to shell 12 and provides fluid communication between a suction accumulator (not illustrated) in a refrigeration system and suction chamber 18. Suction chamber 18 is defined by bore 20-1 in cylinder 20, piston 22, pump end bearing 24 and motor end bearing 28.

Oil pick up tube 34 extends from sump 36, through pump end bearing cover 30 to shaft 40 which is partially located in bore 24-1 of pump end bearing 24. Shaft 40 includes a portion 40-1 supportingly received in bore 24-1 of pump end bearing 24, eccentric 40-2 which is received in bore 22-1 of piston 22, and portion 40-3 supportingly received in bore 28-1 of motor end bearing 28. Stator 42 is secured to shell 12 by welding or any other suitable means. Rotor 44 is suitably secured to shaft 40, as by a shrink fit, and is located within bore 42-1 of stator 42.

Special casing 50 is located in and radially spaced from shell 12. Casing 50 engages motor end bearing 28 and stator 42 so as to minimize leakage at operating conditions and to direct essentially all of the discharge flow downstream of muffler 32 into the annular gap 43 formed between stator 42 and rotor 44. This prevents contact between the oil in sump 36 and rotor 44 and helps to reduce oil circulation. If necessary, or desired, casing 50 could be tightly sealed to bearing 28 and stator 42 but satisfactory operation does not require a tight seal.

In operation, rotor 44 and shaft 40 rotate as a unit and eccentric 40-2 causes movement of piston 22. Piston 22 coacts with a vane (not illustrated) in a conventional manner such that gas is drawn through suction tube 16 to suction chamber 18. The gas in suction chamber 18 is compressed and discharged via discharge valve 29 into the interior of muffler 32. The compressed gas passes through muffler 32 into the interior of casing 50. Gas in casing 50 can only exit via annular gap 43 between the rotating rotor 44 and stator 42 thereby cooling the motor. Due to the rotation of rotor 44, gas passing through gap 43 tends to be subjected to being diverted into a spiraling path which serves to centrifugally separate entrained oil which is collected on the wall of bore 42-1 and forced along by the gas. Gas passing from gap 43 will tend to impinge upon the inner surface of cover 12-1 further contributing to oil separation. Because discharge line 60 is located at the top of the compressor 10 or 10', the discharge gas within chamber 13, defined by cover 12-1, passes between the upper portion of shell 12 and the members in a flow path 180° in direction from the path through gap 43. Specifically, discharge gas passes from chamber 13 through a continuous flow path defined by the upper interior portion of shell 12 and groove 42-2 which is located in flat 42-4 in stator 42, the upper portion of annular space 50-1 defined between shell 12 and casing 50. Passage 20-2 in cylinder 20 provides a continuous path to pump bearing chamber 38. Chamber 38 is located above sump 36 and is connected to the refrigeration or air conditioning system (not illustrated) via passage 20-2 and discharge line 60. It will be noted that flow from muffler 32 to chamber 13 is via a restricted path defined by annular gap 43 and flow from chamber 13 to chamber 38 is via the restricted path defined in part by groove 42-2 and flat 42-4. As a result, the pressure in chamber 13 will tend to be higher than that in chamber 38 and thereby in sump 36 during normal operating conditions.

Oil from sump 36 is drawn through oil pick up tube 34 into bore 40-4 which may be skewed relative to the axis of rotation of shaft 40 and acts as a centrifugal pump. Pumping is necessary to overcome the pressure differential noted above between chambers 38 and 13. As best shown in FIG. 2, oil delivered to bore 40-4 is able to flow into a series of radially extending passages, exemplified by 40-5, 40-6 and 40-7, to lubricate bearing 24, piston 22, and bearing 28, respectively. The excess oil flows from bore 40-4 and either passes downwardly over the rotor 44 and stator 42 to the bottom of chamber 13 or is carried by the gas flowing from annular gap 43 and impinges and collects on the inside of cover 12-1 before draining to the bottom of chamber 13. As noted above, chamber 13 is at a higher pressure than chamber 38 so that oil draining to the bottom of chamber 13 will flow along the bottom of shell 12 into sump 36 via a continuous path defined by groove 42-3 which is located in a flat 42-5 in stator 42 as well as flat 42-5, the lower portion of annular space 50-1 and groove or passage 20-3. Further, because chamber 38 is at a lower pressure, the level in sump 36 can be higher than it otherwise might be during operation.

Oil distributed to the bearings 24 and 28 and piston 22 for lubrication may drain to the sump 36 or be entrained by the compressed refrigerant passing from muffler 32. However, the flows through annular gap 43 and grooves 42-2 and 42-3 each serve to cool the windings of stator 42 as well as the rotor 44.

Referring now to FIG. 2, the operation of compressor 10' is the same as that of compressor 10 except for rotor fan 80. As best shown in FIG. 1, the end of rotor 44 is crenulated and has a number of notches or slots 44-1. Rotor fan 80 is secured to the end of rotor 44 thereby closing the axial flow path and defining a plurality of radial ports 80-1. Rotor fan 80 serves two functions. First rotor fan 80 assists in pumping oil from sump 36 and, second, rotor fan 80 forces the oil passing from bore 40-4 radially outward, across gap 43 to the surface defining bore 42-1.

Although preferred embodiments of the present invention have been illustrated and described, other modifications will occur to those skilled in the art. It is therefore intended that the present invention is to be limited only by the scope of the appended claims.

What is claimed is:

1. A high side horizontal rotary compressor comprising:

a shell having a first end and a second end;

a cylinder containing a pump including a piston and fixedly located in said shell near said first end and defining with said first end a first chamber which has an oil sump located at the bottom thereof;

bearing means secured to said cylinder and extending towards said second end;

motor means including a rotor and a stator;

said stator fixedly located in said shell between said cylinder and said second end and axially spaced from said cylinder and said bearing means;

said stator defining a second chamber with said second end;

a shaft supported by said bearing means and including an eccentric operatively connected to said piston;

said rotor secured to said shaft so as to be integral therewith and located within said stator so as to define therewith an annular gap;

muffler means secured to said bearing means;

an annular casing in said shell extending between said cylinder and said stator and surrounding at least a portion of said muffler means and said bearing means;

suction means for supplying gas to said pump;

first fluid path means connecting said second chamber with said first chamber and being partially located between an upper portion of said shell and said stator;

discharge means fluidly connected to said first fluid path means downstream of said stator whereby gas compressed by said pump serially passes through said muffler means, said annular gap, said second chamber, said first fluid path means, and out said discharge means.

2. The compressor of claim 1 further including second fluid path means connecting said second chamber with said sump and being partially located between a lower portion of said shell and said stator whereby oil reaching said second chamber can return to said sump.

3. The compressor of claim 2 wherein flow through said annular gap and said first and second fluid path means serves to cool said motor.

4. The compressor of claim 1 further including:

oil distribution means formed in said shaft; and means for supplying oil from said sump to said oil distribution means.

* * * * *